United States Patent [19]

Daane et al.

[11] Patent Number: 4,925,077

[45] Date of Patent: May 15, 1990

[54] CONTACTLESS TURNING GUIDE FOR RUNNING WEB

[75] Inventors: Robert A. Daane; Randall D. Helms, both of Green Bay, Wis.

[73] Assignee: Advance Systems, Inc., Green Bay, Wis.

[21] Appl. No.: 347,514

[22] Filed: May 4, 1989

[51] Int. Cl.[5] ..... B65H 20/14

[52] U.S. Cl. ..... 226/97; 226/196

[58] Field of Search ..... 226/97, 196; 242/76; 384/100

[56] References Cited

U.S. PATENT DOCUMENTS

| | | | |
|---|---|---|---|
| 3,398,870 | 8/1968 | Mullan et al. | 226/97 |
| 4,182,472 | 8/1981 | Peekna | 226/97 |
| 4,197,972 | 4/1980 | Daane | 226/97 |
| 4,282,998 | 8/1981 | Peekna | 226/97 |
| 4,342,413 | 8/1982 | Reba | 226/97 |
| 4,430,012 | 2/1984 | Kooy et al. | 242/76 X |
| 4,671,676 | 6/1987 | Chen et al. | 384/100 |

*Primary Examiner*—Stuart S. Levy
*Assistant Examiner*—Paul Thomas Bowen
*Attorney, Agent, or Firm*—Nilles & Nilles

[57] ABSTRACT

An arcuate turning guide for a running web over which the running web is floatingly suspended on a cushion of air. The guide has a pair of air nozzle slots positioned transversely and spaced circumferentially apart from one another, the slots being directed toward one another for providing pressurized air to said air cushion. The air slots are defined in part by a nozzle knife which has a sharp nozzle defining edge and also has a heel edge, the guide has a pocket for securely receiving the knife heel edge, and an adjustment is provided for the sharp edge to vary the width of the nozzle slot. The guide has a pair of vane members, one located at each transverse end of the guide, and adjustable means are provided for selectively adjusting said vane members transversely toward and away from one another. The vane members each having an edge dam located adjacent its respective web edge, and the vane members also have inclined and opposed air directing vanes to thereby direct air toward the transverse center of the air cushion. A series of extruded metal, interlocking parts together define the arcuate turning guide to provide the desired degree of wrap of the guide.

15 Claims, 4 Drawing Sheets

CONTACTLESS TURNING GUIDE FOR RUNNING WEB

BACKGROUND OF THE INVENTION

1. Field of the Invention

The present invention pertains to advancing material of indeterminate length through an arcuate guide on a cushion of pressurized air. The arcuate guide floatingly suspends a running web on a cushion of air without contacting the guide.

2. Background Information

The invention pertains to contactless turning guides for a running web and for guiding and controlling a running web through a change of direction. These turning guides are also commonly referred to as air rolls or air turns and are formed as a partial drum-like member having an arcuately curved surface which can be variable as to its transverse length and also variable as to the length of its arc. These prior art turning guides have a transverse nozzle slot at both the beginning and end of the arcuate path for supplying pressurized air to the air cushion located therebetween. Generally the prior art devices do not have a steering device to prevent the web from lateral side-to-side motion, and instead the running web weaves uncontrollably back and forth in a transverse direction. This is referred to as "web weave" and sometimes becomes so severe that the web may rub against the machine frame members, and tear, thereby causing a shut down of the machine for re-webbing. In modern printing presses, web weave caused by guideless air turns is one of the major causes for lost production time.

One prior art contactless turning guide is shown in U.S. Pat. No. 4,197,972 which issued Apr. 15, 1980 to Robert A. Daane, one of the inventors in this present application. Other prior art examples are shown in the U.S. Pat. No. 4,182,472, issued on Jan. 8, 1980 and U.S. Pat. No. 4,282,998, issued Aug. 11, 1981, both issued to Peekna.

SUMMARY OF THE INVENTION

One aspect of the present invention relates to an air guide for a running web and for supporting the running web over an arcuate path and without contact with the air guide. The air guide of the present invention includes two opposed, circumferentially spaced, transversely arranged air supply nozzle slots, which guide also has transversely movable vane members having an edge dam and air directing vanes, one vane member being located at each side of the web. The vane members are movable transversely for adjustment relative to the web edges. These vane members are positionable closely adjacent the edges of the web and provide both pneumatic and mechanical restraint against the web wandering in a sidewise direction. The arrangement is such that as one edge of the web comes too close to the edge dam of the vane member, the air which escapes out from under the web edge is inhibited and a higher cushion of pressure is created at that edge. This higher cushion pressure pushes the web radially outward which results in a component of force pushing the web back away from the air guide edge. Because the web is curved as it passes around the air guide, the web is greatly stiffened against buckling or wrinkling and furthermore the web is under considerable machine direction tension, which adds to the web stiffness.

Another aspect of the present invention is to provide an air guide of the above type in which the members having edge dams and air vanes are slidable transversely toward and away from one another, that is, they are adjustable in a transverse direction in respect to the web located therebetween, to thereby accommodate various web widths and "cross machine" web positions. Between the edge dam members a vacant space is provided which acts as an enlarged cushion or reservoir of pressure air and which cushion reduces fluctuations in air pressure within the air guide.

Another important aspect of the present invention relates to an air guide of the above type in which the transversely movable vane members have diverging flow deflecting vanes which direct the air pressure inwardly from the web edges and toward the center of the web. In other words, these opposed, inclined, and converging vanes act to prevent the cushion air in the air guide from escaping transversely past the edges thereof. In addition to deflecting the cushion air towards the center of the web, the divergence of the vanes of the present invention leads to an air pressure increase as the air flows towards the center of the web wrap arc, because the divergence of the vanes leads to a velocity decrease which in turn leads to a pressure increase.

Yet a more specific aspect of the invention relates to an air guide of the above type in which the members having air dams and vanes are formed preferably as molded plastic parts. These parts also have a transversely extending, center flange along their transverse length and this center flange provides a cross web direction vane which is generally parallel to the air guide axis at the center of the web wrap arc. This transversely extending transverse flange is of the same height as the diverging flow deflector vanes. The transversely arranged center vane helps prevent the "flip-flop" behavior of the web, that is, it prevents the air flow from one of the air supply nozzle slots at the arcuate extremity of the air guide from sweeping all the way across the arcuate surface of the air guide and which would otherwise overpower the air jet coming from the opposed transverse slot at the other arcuate extremity of the air guide.

Another aspect of the invention relates to a guide of the above type having a series of interlocking and removable arcuate parts, each of the parts having an arcuate surface which together define said arcuate surface of said guide, whereby guides of different degrees of arcuate wrap can be assembled. Thus the extent of radial turning movement of the web can be fabricated from some common members, for example, a 90° turn or a 40°. This is accomplished by having members formed as small cross section extrusions, without requiring excessive extrusion pressure in their manufacture.

Another aspect of the invention relates to a guide of the above type having nozzle knives for defining, in part, the said nozzle slot, pocket means for holding the rear edge of said knife securely captive, and means for adjustably positioning the sharp edge of said knife to vary the size of said nozzle slot.

Still another aspect of the invention relates to the above guide having a perforated air distribution plate located radially within said nozzle slot for distributing pressurized air along the transverse length of said slot.

These and other objects and advantages of the present invention will appear hereinafter as this disclosure progresses, reference being had to the accompanying drawings.

DESCRIPTION OF THE PREFERRED EMBODIMENTS

Figure 1:
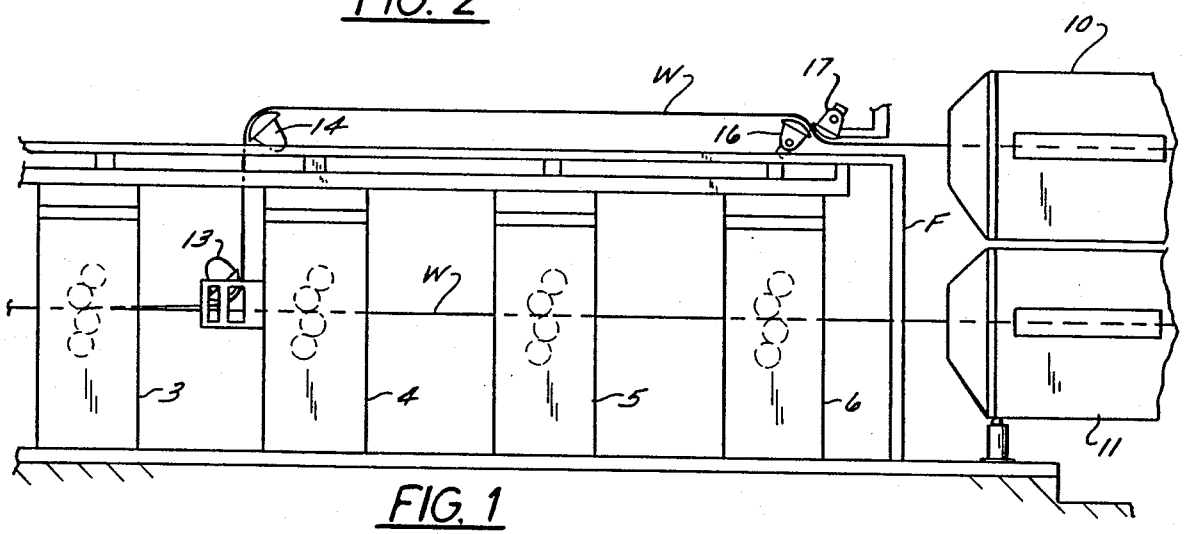
FIG. 1 is a schematic, elevational, side view of a series of web presses from which the web is fed into web dryers, and showing the environment in which the present invention is used.

The general environment in which the present invention is used is shown in FIG. 1 and includes a series of web presses 3, 4, 5 and 6 which are arranged in line in the conventional manner and through which the webs W pass to their respective web dryers 10 and 11. For the purpose of describing the present invention, reference will be made to one of the webs W which after leaving the last of its web presses 3 must be turned at two right angle degrees to position it above the remaining presses. The web subsequently enters the conventional web dryer 10 for further processing. In conducting the web through its path from the last printing press 3 to the dryer 10, a pair of 90° air guides 13, 14 are utilized and also a pair of 40° turn air guides 16, 17 are used to floatingly guide the web without contact from the last web press 3 and into the web dryer 10. The guides are angularly adjustable on the press frame F by means of their stub shafts 12 and 15 (FIGS. 4, 5, 6 and 9), which are secured to the guide side frame 12A and 15A, respectively.

Figure 2:
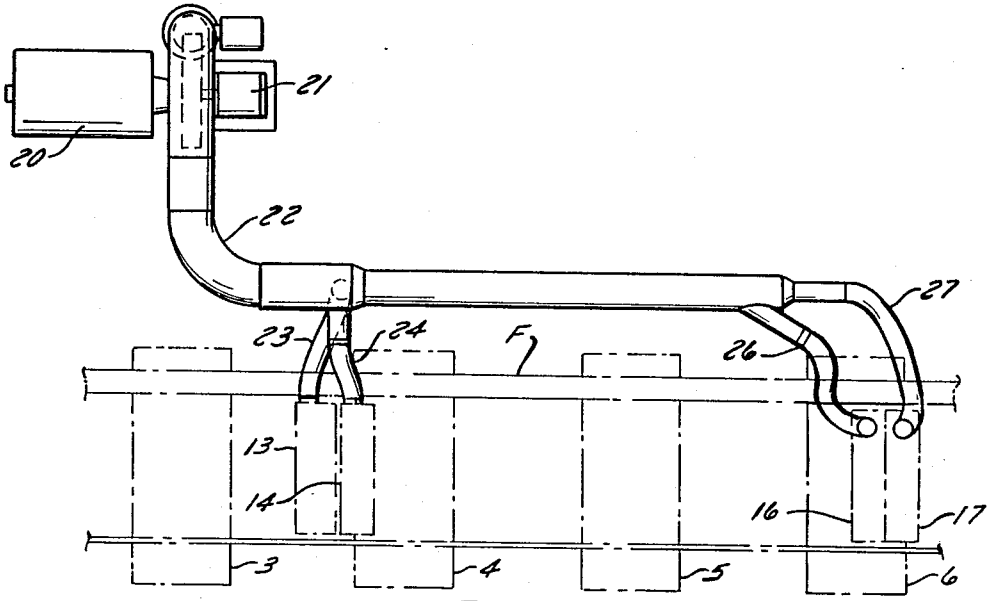
FIG. 2 is a schematic plan view of the arrangement shown in FIG. 1 and including the air supply means for the air guides.
Figure 3:
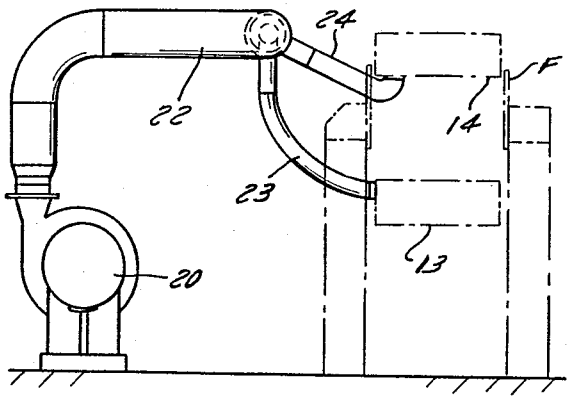
FIG. 3 is a schematic, elevational, end view of the air supply means and web presses shown in FIG. 2.

As shown in FIGS. 2 and 3, a source of air such as a blower 20 driven by its motor 21 conducts air through the main duct 22 and then through the auxiliary ducts 23, 24 to furnish supply air, respectively, to the 90° air guides 13, 14. The main duct 22 also furnishes supply air to the auxiliary ducts 26, 27 to furnish air, respectively, to the 40° air guides 16, 17.

The air guides themselves will now be described in greater detail, it being understood that the construction of the 90° air guides 13, 14 is generally similar and that the 40° air guides 16, 17 are also generally similar to one another.

The air guides have air supply housings 30 (FIG. 9) for the 90° air guides and air supply housings 31 (FIG. 6) for the 40° air guides. Air is conducted from the auxiliary ducts into the housings 30, 31 and then this pressurized air exits from the housings through the respective perforated air distribution plates 32, 33 which are fixed across the respective housings. The air distribution plates act to distribute the air evenly across the length of the air guides now to be described in detail.

Figure 4:
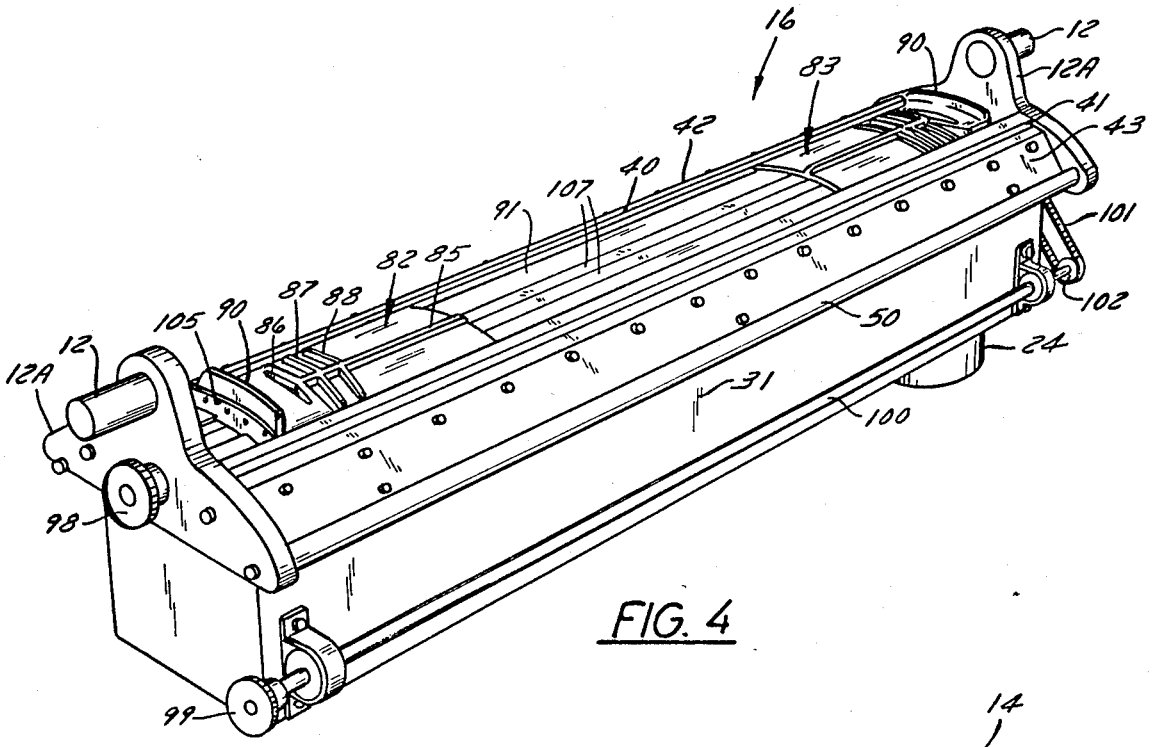
FIG. 4 is a perspective view of the 40° air guides shown in FIG. 1, but on an enlarged scale.
Figure 5:
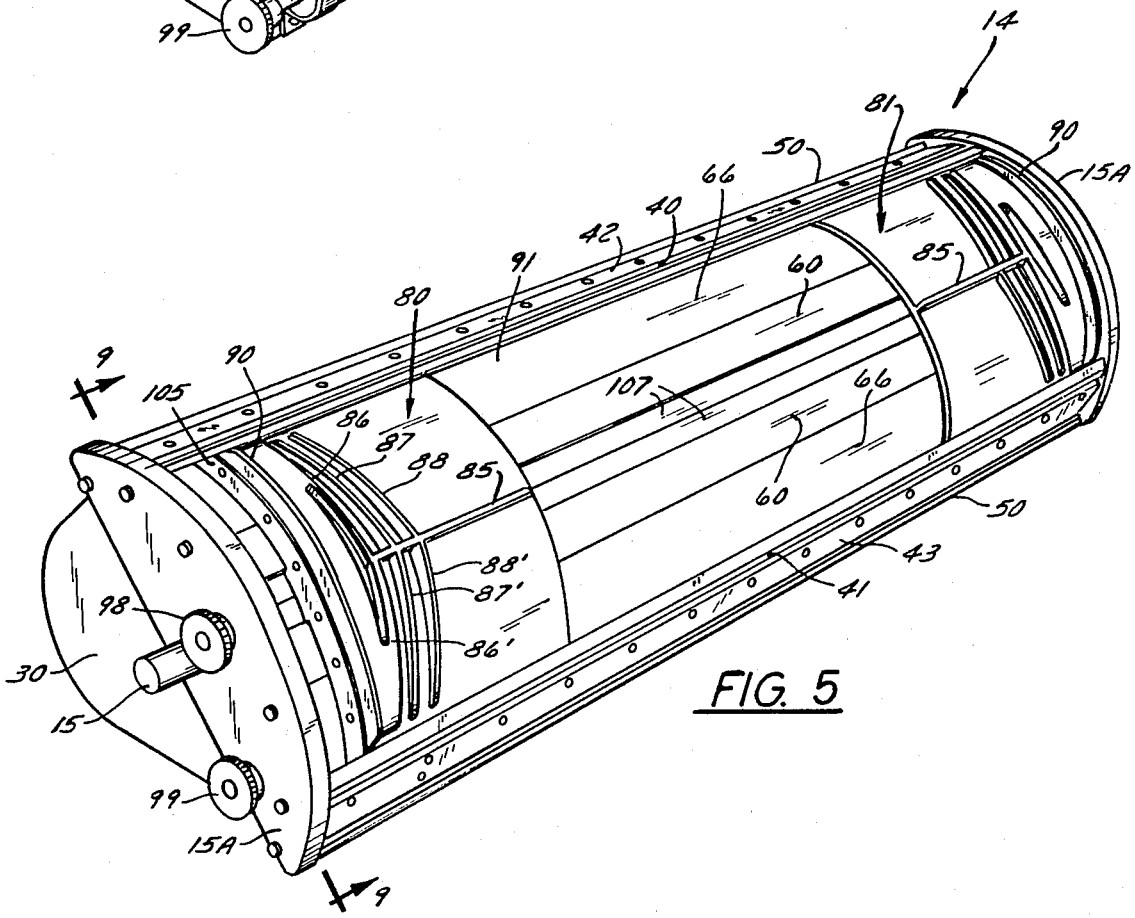
FIG. 5 is a perspective view of the 90° air guides shown in FIG. 1, but on an enlarged scale.

Generally, the air guides, shown in FIGS. 4 and 5, for a 40° turn and for a 90° turn, respectively, are similar in construction and function, except for the details to be referred to later. The guides act to floatingly suspend the running web through their respective arcuate surfaces, which surfaces extend in the direction of web movement. The guides themselves are generally elongated and extend transversely across the path of web movement. As the web passes over the arcuate guides, a cushion of pressurized air is formed between the guides and the web to floatingly suspend the web without contact.

Figure 6:
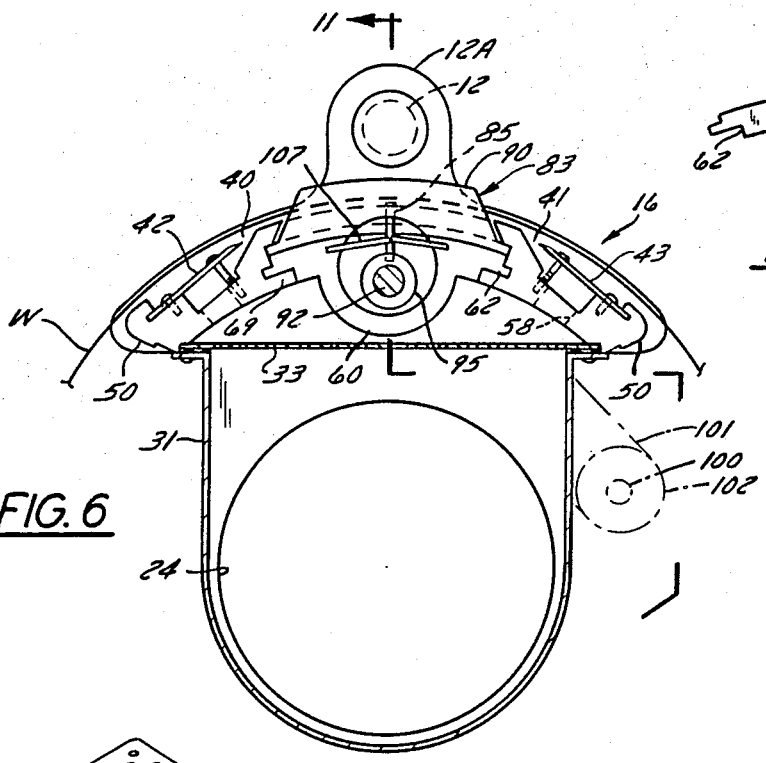
FIG. 6 is a transverse sectional view, generally along line 6—6 in FIG. 11, through the 40° turn shown in FIGS. 4 and 11, but on an enlarged scale.
Figure 7:
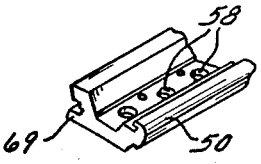
FIG. 7 is a fragmentary, perspective view of the knife nozzle part mounting leg shown in FIGS. 6, 7 and 9.
Figure 9:
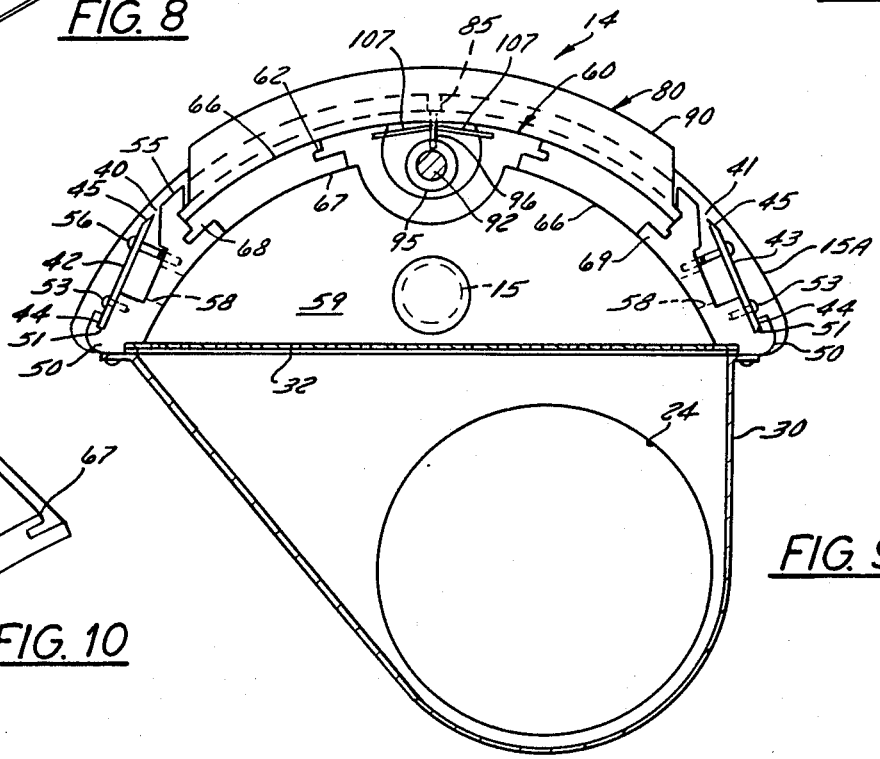
FIG. 9 is a transverse sectional view through the 90° guide shown in FIG. 5; and generally along line 9—9 in that view.

Each of the guides have a pair of air nozzle slots 40, 41 positioned transversely along the guide and spaced circumferentially apart from one another, as clearly shown in FIGS. 6 and 9. The slots being directed toward one another provide pressurized air to the air cushion which is formed between the opposed slots and the web W and the arcuate surface of the guides. Nozzle slots 40, 41 are formed in part by the transversely extending nozzle knives 42, 43, respectively. The knives having heel portion 44 and a sharp nozzle defining edge 45. As the construction of the knives and their mounting are similar for both the FIG. 6 and FIG. 9 guides, reference will be made to only one of them. The guides have a tranversely extending leg 50 in which is formed a pocket 51 which receives the heel of the knife and holds it securely captive therein, thereby preventing shifting of the knife once it is adjusted. A screw means 53 extends through the knife and is threadably engaged in the leg 50. The sharp edge 45 of the knife is adjusted relative to the outer, arcuate portion of the guide by means of the threaded bolt 56 which is threadably engaged in the leg 50. In this manner the air slot 40 can be precisely adjusted. Member 50 has a series of holes 58 (FIGS. 6, 7 and 9) extending along its length and through which the supply air passes from the interior 59 of the arcuate member, through the nozzle slots and into the air cushion previously mentioned. Thus a knife pocket is provided for receiving and holding the heel edge, and adjustment means if provided for adjusting the radial position of the nozzle defining edge of the knife to thereby vary the width of the nozzle slots 40, 41.

Figure 6A:
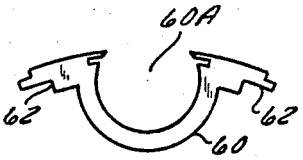
FIG. 6A is an elevational end view of the center common member.
Figure 8:
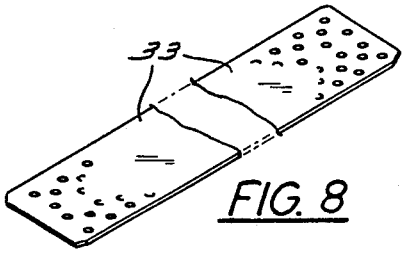
FIG. 8 is a perspective view of the air distribution plate shown in FIG. 6, but on a reduced scale and with a portion broken away for clarity.
Figure 10:
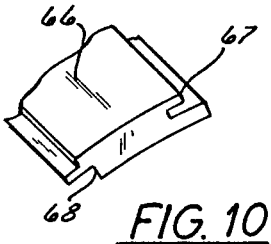
FIG. 10 is a fragmentary, perspective view of part of one air guide member.

The air guides include a series of transversely extending, extruded metal interlocking and removable parts including the center common member 60 (FIG. 6A) which is common to both the 40° guide and the 90° guide. Member 60 has an arcuate inner wall (FIG. 6A) which defines a chamber 60A. The extruded member 60 has interlocking edges 62 along each of its transversely extending sides (FIGS. 6, 6A and 9). The arcuate guide shown in FIG. 9 also has a pair of intermediate extruded metal parts 66 which have interlocking, complementary and interengageable locking edges 67, 68 (FIG. 10) along its transverse edges. In this manner the intermediate part 66 can be locked to (and then welded) the center part 60 and to the leg part 50 to form a rigid, continuous arcuate member over which the web is guided on the cushion of air. It will be noted that the leg part 50 also has an interengaging, complementary, interlocking part 69 (FIGS. 6, 7 and 9) which is connected together with the intermediate part 66 in FIG. 9 when a 90° turn is used. Leg part can be assembled with the common, central part 60 as shown in FIG. 6 when a 40° turn is used.

The arrangement shown for the 40° guide in FIG. 6 is generally similar to that shown in the FIG. 9 arrangement except that the intermediate parts 66 are not used and the legs 50 are directly interconnected with the common center part 60, thus resulting in a 40° wrap guide. Thus the guide has interlocking parts with complementary and interengageable locking edges that extend transversely therealong, whereby the parts can be locked together to provide the arcuate degree of web wrap desired. After they are assembled as shown in either FIGS. 6 or 9, the parts are spot welded together. With this construction, common parts 60 and 50 are used for both the 40° guide and the 90° guide. This permits extrusion of these parts without excessive extrusion pressures being required in their manufacture.

Reference will now be made to the pair of vane members 80, 81 of the FIGS. 5 and 9 embodiment and to air vane members 82, 83 of the FIGS. 4 and 6 embodiment. Generally the construction and function of the air vane members of both embodiments are the same, the difference being in the arcuate length of the air vane members. Consequently, it is believed a description of only the air vane members 80, 81 in connection with the 90° air guide, will suffice for purposes of this disclosure.

Figure 12:
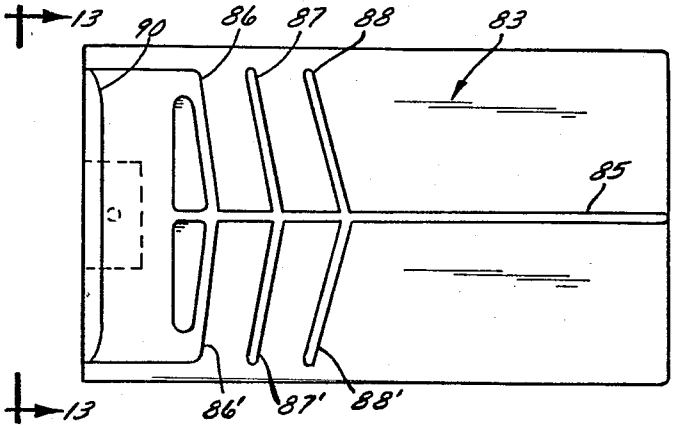
FIG. 12 is a view of the transversely adjustable vane member of the air turn, the view being taken generally along the line 12—12 in FIG. 11.
Figure 13:
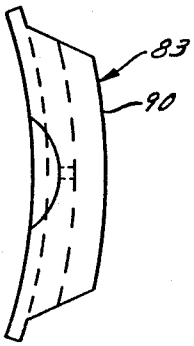
FIG. 13 is an end view of the vane member shown in FIG. 12 and taken along line 13—13 therein.

The air vane members are fabricated, preferably, of molded plastic, one being located at each transverse end of the guide. The vane members are arcuate in shape to complement the arcuate surface of the extruded metal parts previously mentioned. The vane members have an edge dam 90 formed integrally therewith and which is located adjacent its respective web edge. The dam extends generally coextensive with the arcuate length of the air vane member. The guides also have a transversely extending centerline on which is formed a transversely extending air vane 85. On one side of the center vane 85 are a plurality of inclined, converging air vanes 86, 87, 88, which are clearly shown in FIGS. 4, 5, and 12. Similar inclined air directing vanes 86', 87' and 88' are located on the opposite side of the centerline vane 85 (FIGS. 4, 5, 6, 9 and 12) and converge towards vanes 86, 87 and 88 in a direction towards the longitudinal center of the air guide.

The cushion of air beneath the web has a tendency to try to escape out of each end of the air guide which would result in loss of cushion air pressure. The inclined vanes act to direct the air towards the transverse center of the air cushion and thus maintain the air pressure.

It will be noted that the opposed air vane members 80, 81 are transversely spaced apart from one another to define a central, enlarged volume portion 91 (FIG. 5) of the air cushion.

The edge dams 90 of the air vane members are locatable, as will appear, closely adjacent the edges of the running web to thereby accommodate various web widths and "cross machine" web positions. The edge dams prevent lateral escape of the air from beneath the web.

The transversely arranged center vane 85 is of the same height as the inclined vanes 86, 87 and 88 and helps prevent flip-flop behavior of the web. That is to say it prevents the air flow from one of the supply nozzles at the arcuate extremity of the air guide from sweeping all away across the arcuate surface of the air guide to overpower the air jet coming from the opposed transverse slot at the other arcuate extremity of the air guide. In other words, the centerline vane 85 prevents air flow from one slot sweeping all away across the wrap surface of the air guide and overpowering the jet coming out of the other air slot. The web clearance is very small at the first slot and at the central region of the web wrap and is much larger at the second slot. The direction of this air sweep depends on how it gets started. If the web is pushed down at one of the slots it will stay there. A downward push at the other slot reverses the flow and clearance patterns. This is referred to as flip-flop behavior of the web.

In regard to the angled or inclined vanes, they deflect air flow towards the center of the web and need be placed only within a few inches of the web edges, that is, from the edge dam vanes. It has been found particularly successful to use vanes which are about ½ inch high by ⅛ inch thick and which are about ½ inch apart near each slot and which diverge to about one inch apart at the center of the web wrap arc. In addition to deflecting the air towards the center of the web, the divergence of the vanes results in a pressure increase as the air flows towards the center of the wrap arc because the divergence leads to a velocity decrease which in turn leads to a pressure increase.

Referring again to the edge dam vanes 90, the moving webs will ride with its edges close to the edge dams, and the dams provide both pneumatic and mechanical restraint against the web wandering sideways. Specifically, as one edge of the web becomes too close to the edge dam, the air-escape out from under the web edge is inhibited and a higher cushion pressure is created at that edge. This higher cushion pressure pushes the web radially outwardly leading to a component of force pushing the web back away from the edge dam. If this force is not great enough, the web edge may actually rub on the edge dam, thus leading to direct mechanical restraint. If the web were flat in this region, this mechanical restraint would lead to buckling or wrinkling of the web. However, while the web is on the air turn, it is greatly stiffened against such buckling and wrinkling and the web is under considerable machine direction tension, which adds to this web stiffness.

Figure 11:
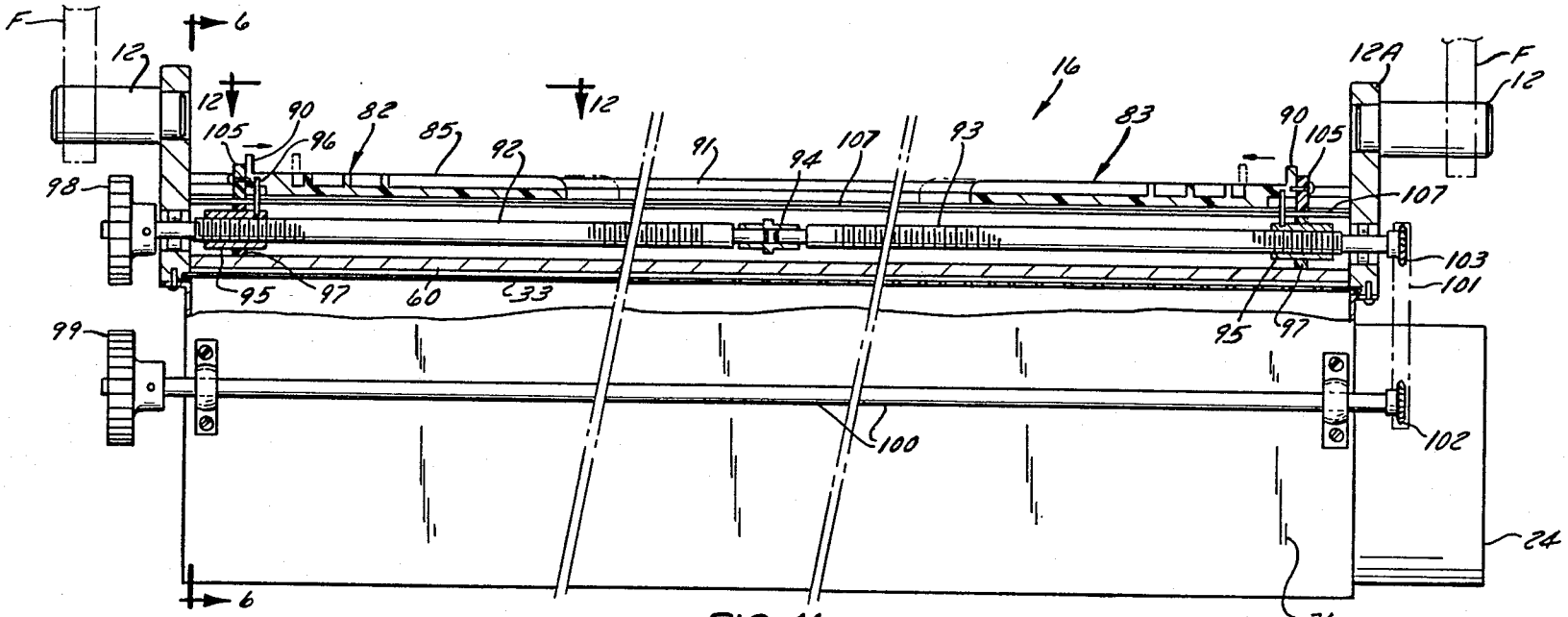
FIG. 11 is a transverse view taken on line 11—11 in FIG. 6, partially in section.
Figure 14:
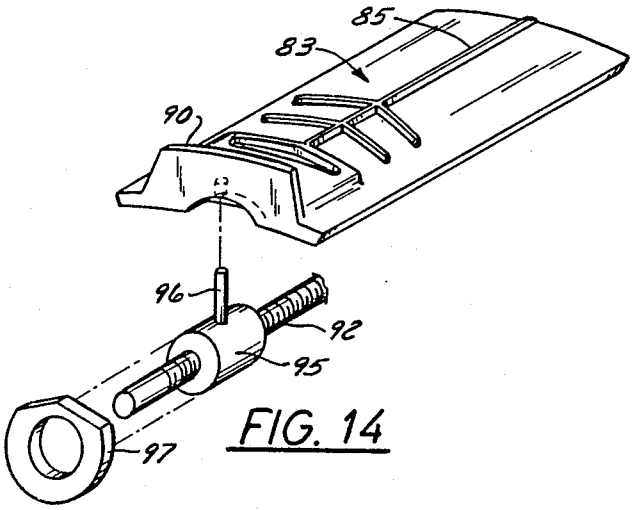
FIG. 14 is a perspective view of the running nut and the vane driver connected thereto, and a fragmentary part of the vane member, as shown in FIG. 11.

Means are provided for transversely adjusting the position of the air vane members toward and away from one another, as previously mentioned. This means is shown in FIG. 11, for example, and includes drive screws 92, 93 which are freely piloted at their inner ends in a bushing 94. Mounted on the threaded outer end of drive screw 92 is the running nut 95 which is connected to the vane driver pin 96 (FIGS. 9, 11 and 14). A "D" shaped seal 97 is attached to the nut 95 for helping to seal the chamber 60A (FIG. 6A) in which the screw shafts 92, 93 are located. A similar arrangement provided for the drive screw 93 is clearly shown. Each of the drive screws is separately and independently adjusted so that each of the air vane members can be individually adjusted relative to the web. For example, for rotating the drive screw 92 a hand knob 98 is provided on its outer end. A hand knob 99 through the cross shaft 100 acts through the chain 101 and sprockets 102, 103 to rotate the drive screw 93. Arcuately shaped, flat, rubber seals 105 (FIGS. 4, 5 and 11) are attached to the outer ends of the vane members. Longitudinal, flexible seals 107 (FIGS. 5 and 9) are mounted in the common center member 60 and enclose chamber 60A to protect the threaded screws 92 and 93 from dust and dirt. Vane driver pins 96 extend between the adjacent edges of seals 107 which also act to seal around these pin 96.

We claim:

1. A contactless turning guide for a running web and having an arcuate surface extending in the direction web movement and over which arcuate surface the running web is floatingly suspended on a cushion of air, said guide extending transversely across the web, said guide having a pair of air nozzle slots positioned transversely along the guide and spaced circumferentially apart from one another, said slots being directed toward one another for providing pressurized air to said air cushion located therebetween and between said web and said arcuate surface, said guide having a pair of vane members, one located at each transverse end of the guide, adjustable means for selectively adjusting said vane members tranversely toward and away from one another, said guide having a series of transversely extending, extruded metal interlocking parts which together define said arcuate surface of said guide.

2. The guide set forth in claim 1 wherein said interlocking parts have complementary and interengageable locking edges extending transversely therealong whereby said parts can be selectively locked together to form the arcuate degree desired of said web wrap.

3. The guide set forth in claim 1 wherein said nozzle slots are defined in part by a transversely extending nozzle knife having a sharp nozzle defining edge and also having a rear heel edge, said guide having a knife pocket for receiving and holding said heel edge, and adjustment means adjusting the radial position of said nozzle defining edge said knife to thereby vary the width of said slot.

4. A contactless turning guide for a running web and having an arcuate surface extending in the direction of web movement and over which arcuate surface the running web is floatingly suspended on a cushion of air, said guide extending transversely across the web, said guide having a pair of air nozzle slots positioned transversely along the guide and spaced circumferentially apart from one another, said slots being directed toward one another for providing pressurized air to said air cushion located therebetween and between said web and said arcuate surface, said guide having a pair of vane members, one located at each transverse end of the guide, adjustable means for selectively adjusting said vane members tranversely toward and away from one another, said vane members each having an edge dam for being located adjacent its respective web edge, said vane members also each having opposed inclined air directing vanes, said opposed vanes converging with one another towards the center of the guide to thereby direct air toward the transverse center of said air cushion.

5. The guide described in claim 4 further characterized in that said guide has a series of transversely extending, extruded metal interlocking parts which together define said arcuate surface of said guide.

6. The guide set forth in claim 5 wherein said interlocking parts have complementary and interengageable locking edges extending transversely therealong whereby said parts can be selectively locked together to provide the arcuate degree of web wrap desired.

7. The guide set forth in claim 4 wherein said nozzle slots are defined in part by a transversely extending nozzle knife having a sharp nozzle defining edge and also having a rear heel edge, said guide having a knife pocket for receiving and holding said heel edge, and adjustment means for adjusting the radial position of said nozzle defining edge of said knife to thereby vary the width of said slot.

8. A contactless turning guide for a running web and having an arcuate surface extending in the direction of web movement and over which arcuate surface the running web is floatingly suspended on a cushion of air, said guide extending transversely across the web, said guide having a pair of air nozzle slots positioned transversely along the guide and spaced circumferentially apart from one another, said slots being directed toward one another for providing pressurized air to said air cushion located therebetween and between said web and said arcuate surface, said guide having a pair of vane members, one located at each transverse end of the guide, adjustable means for selectively adjusting said vane members tranversely toward and away from one another, said vane members each having an edge dam for being located adjacent its respective web edge, said vane members also each having a transversely extending centerline, said vane members also each having inclined air directing vanes on the opposite sides of said centerline of said vane member, said inclined air vanes on one side of said centerline converging with said vanes on the other side of said centerline to thereby direct air toward the center of said air cushion, said vane members being transversely spaced apart from one another to define an enlarged central portion of said air cushion.

9. The guide set forth in claim 8 further characterized in that said vane members have a transversely extending air vane at their centerline to prevent flip-flop of said web.

10. The guide described in claim 8 further characterized in that said guide has a series of transversely extending, extruded metal interlocking parts which together define said arcuate surface of said guide.

11. The guide set forth in claim 10 wherein said interlocking parts have complementary and interengageable locking edges extending transversely therealong whereby said parts can be selectively locked together to provide the desired arcuate degree of said web wrap.

12. The guide set forth in claim 8 wherein said nozzle slots are defined in part by a transversely extending nozzle knife having a sharp nozzle defining edge and also having a rear heel edge, said guide having a knife pocket for receiving and holding said heel edge, and adjustment means for adjusting the radial position of said nozzle defining edge of said knife to thereby vary the width of said slot.

13. The guide described in claim 8 including a source of pressurized air, and a perforated air distribution plate located radially within said air supply nozzle slots for receiving pressurized air from said source and distributing said air along the length of said nozzle slots.

14. For use in a contactless turning guide for a running web and having an arcuate surface extending in the direction of web movement and over which arcuate surface the running web is floatingly suspended on a cushion of air, said guide extending transversely across the web;

a pair of vane members, one locatable at each transverse end of the guide and having a curved surface conforming to the curve of said arcuate surface, said vane members each having an edge dam for being located adjacent its respective web edge, said vane members also each having opposed inclined air directing vanes, said opposed vanes converging with one another toward the center of the guide to thereby direct air toward the transverse center of said air cushion.

15. For use in a contactless turning guide for a running web and having an arcuate surface extending in the direction of web movement and over which arcuate surface the running web is floatingly suspended on a cushion of air, said guide extending transversely across the web;

a pair of vane members, one located at each transverse end of the guide and having a curved surface conforming to said arcuate surface, adjustable means for selectively adjusting said vane members transversely toward and away from one another, said vane members each having an edge dam for being located adjacent its respective web edge, said vane members also each having a transversely extending centerline, said vane members having a transversely extending air vane at their centerline, said vane members also each having inclined air directing vanes on the opposite sides of said centerline of said vane member, said inclined air vanes on one side of said centerline converging with said vanes on the other side of said centerline to thereby direct air toward the center of said air cushion, said vane members being transversely spaced apart from one another to define an enlarged central portion of said air cushion.

* * * * *